US006874850B2

(12) United States Patent
Berkowicz

(10) Patent No.: US 6,874,850 B2
(45) Date of Patent: Apr. 5, 2005

(54) FOLDING SEAT MODULE SYSTEM AND METHOD OF USING SAME

(76) Inventor: Michael Berkowicz, 215 E. 79th St., New York, NY (US) 10021

( * ) Notice: Subject to any disclaimer, the term of this patent is extended or adjusted under 35 U.S.C. 154(b) by 0 days.

(21) Appl. No.: 10/267,355

(22) Filed: Oct. 9, 2002

(65) Prior Publication Data

US 2003/0168896 A1 Sep. 11, 2003

Related U.S. Application Data

(60) Provisional application No. 60/328,042, filed on Oct. 9, 2001, and provisional application No. 60/342,928, filed on Oct. 19, 2001.

(51) Int. Cl.[7] ..... A47C 15/00

(52) U.S. Cl. ..... 297/248; 297/31; 297/16; 297/188.04; 297/232; 297/249; 297/257; 297/239; 297/440.14; 211/85.8; 211/133.1; 211/13.1

(58) Field of Search ..... 297/248, 31, 16, 297/188.04, 232, 249, 257, 239, 440.14; 211/13.1, 85.8, 133.1, 134; 280/79.3

(56) References Cited

U.S. PATENT DOCUMENTS

| | | | | |
|---|---|---|---|---|
| 1,262,110 A | | 4/1918 | Slack | |
| 1,419,947 A | * | 6/1922 | Schouten | 297/17 |
| 1,961,457 A | | 6/1934 | Schneider | |
| 2,264,491 A | * | 12/1941 | Ward | 297/233 |
| D181,508 S | | 11/1957 | Thorwaldsen | |
| 2,987,111 A | | 6/1961 | Walworth | |
| 3,748,012 A | | 7/1973 | Abelman | 297/440 |
| 3,758,155 A | | 9/1973 | Straits | 297/248 |
| 3,817,573 A | | 6/1974 | Facury | 297/125 |
| 3,999,014 A | | 12/1976 | Bascom | 179/1 AT |
| 4,218,089 A | | 8/1980 | Bertrami et al. | 297/58 |
| 4,359,243 A | | 11/1982 | Crutcher | 297/16 |
| 4,655,504 A | | 4/1987 | Weber | 297/239 |
| 4,879,774 A | | 11/1989 | Sanders | 5/8 |
| 5,170,519 A | | 12/1992 | Meade | 5/37.1 |
| 5,653,507 A | | 8/1997 | Moore | 297/440.14 |
| 5,857,742 A | | 1/1999 | Karl et al. | 297/248 |
| 5,875,904 A | * | 3/1999 | Vorstenbosch | 211/180 |
| 5,890,761 A | | 4/1999 | Miller | 297/232 |
| 5,954,391 A | | 9/1999 | Gray | 297/58 |
| 5,954,396 A | | 9/1999 | Kemnitzer | 297/248 |
| 5,967,605 A | | 10/1999 | Stanfield | 297/239 |
| 6,015,185 A | | 1/2000 | Buono | 297/59 |
| 6,099,073 A | | 8/2000 | Bruschi | 297/59 |
| 6,193,307 B1 | | 2/2001 | Lin et al. | 297/58 |
| 6,231,119 B1 | | 5/2001 | Zheng | 297/16.2 |
| 6,241,106 B1 | * | 6/2001 | Fujita et al. | 211/134 |
| 6,244,657 B1 | | 6/2001 | Momose | 297/217.7 |
| 6,257,660 B1 | | 7/2001 | Calvey | 297/16.1 |
| 6,270,156 B1 | | 8/2001 | Metzger et al. | 297/16.2 |
| 6,402,167 B1 | * | 6/2002 | Calleja | 280/79.3 |

* cited by examiner

*Primary Examiner*—Laurie K. Cranmer
(74) *Attorney, Agent, or Firm*—Synnestvedt & Lechner LLP

(57) ABSTRACT

A portable seating system having a seat module that is foldable between an upright position and a folded position for storage. Multiple up righted modules are connectable to one another to form a row of seat modules. A method of providing portable seating which can be set up for use and then removed for storage is also provided.

26 Claims, 14 Drawing Sheets

FIG. 7A
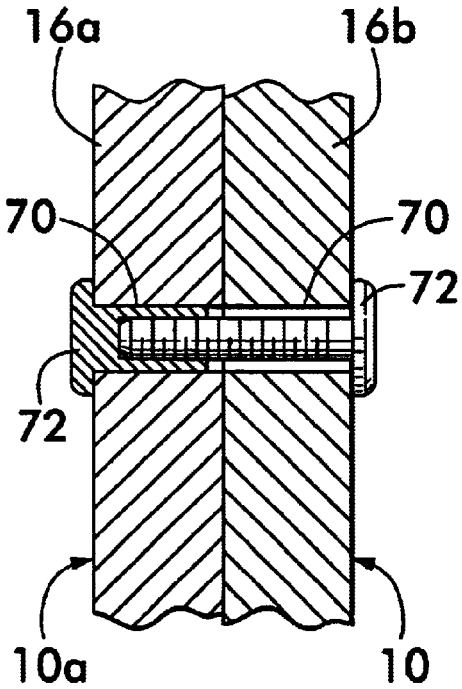
FIG. 7B
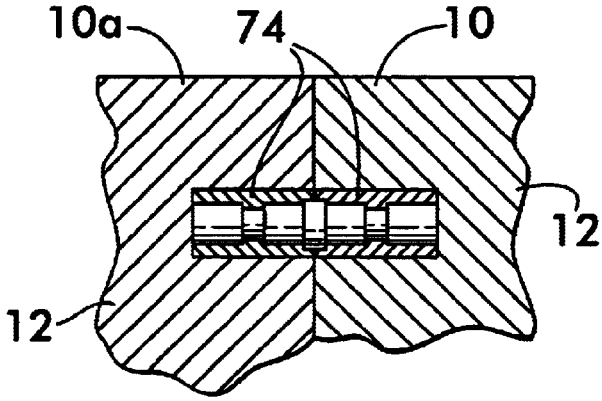
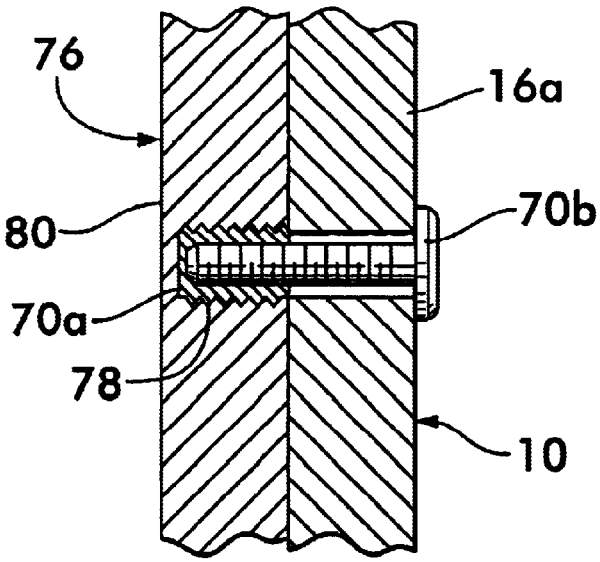
FIG. 7C

FIG.10
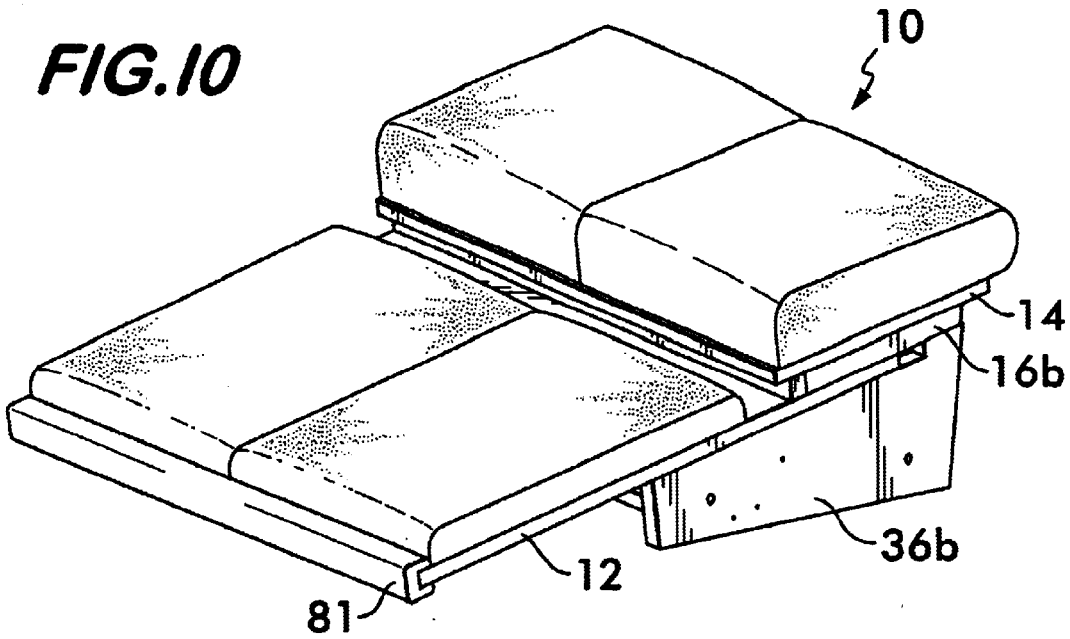
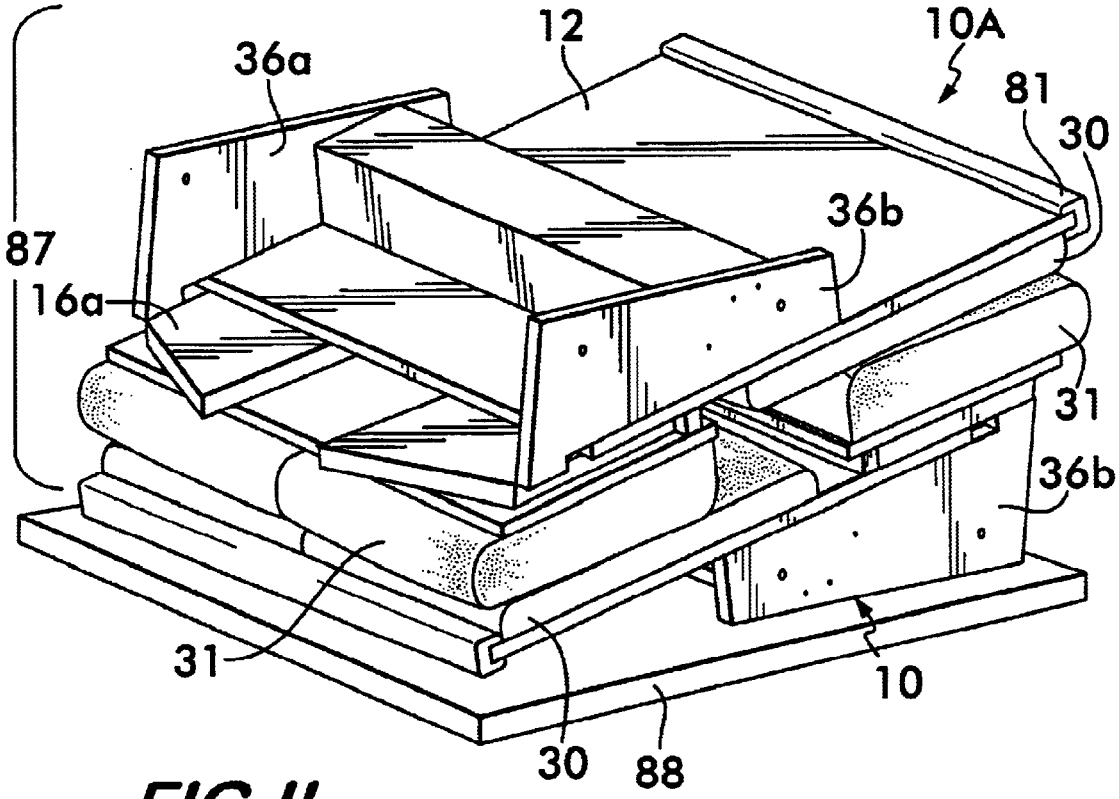
FIG.11

FIG.13A
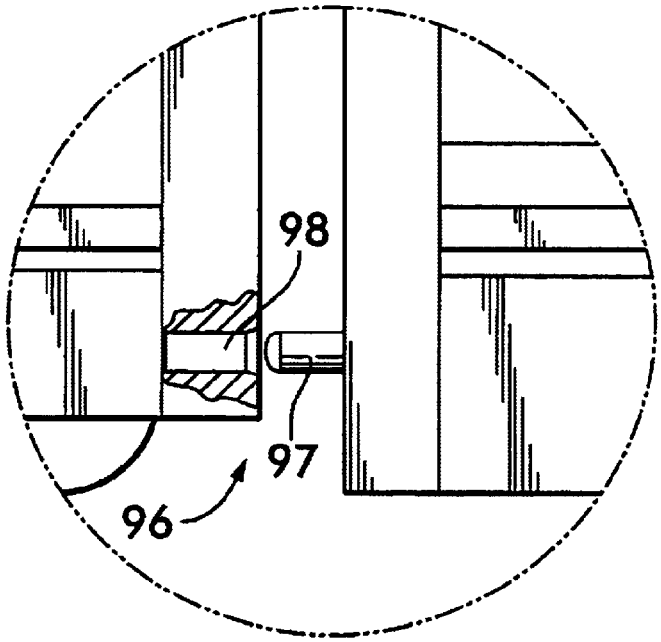
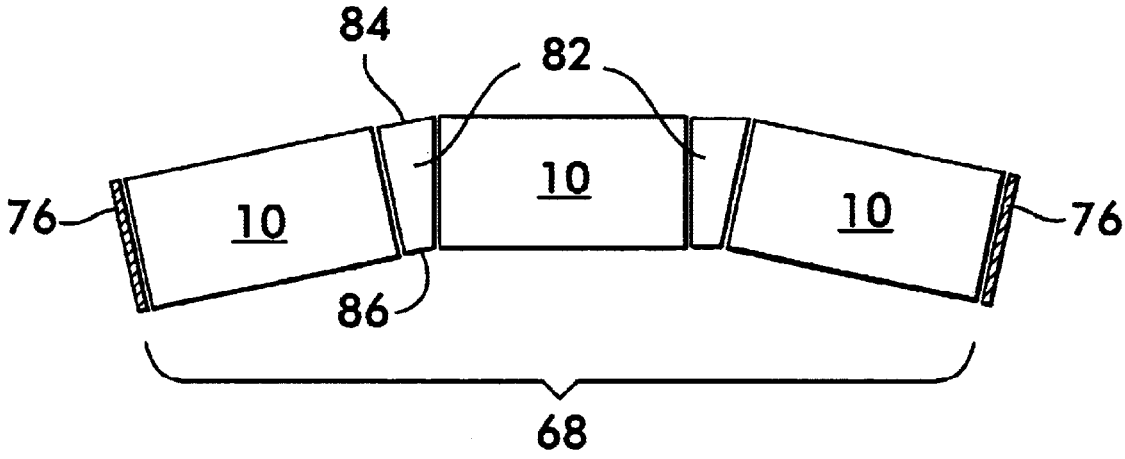
FIG.15

FOLDING SEAT MODULE SYSTEM AND METHOD OF USING SAME

CROSS REFERENCE TO RELATED APPLICATION

This application claims the benefit of U.S. Provisional Application No. 60/328,042 filed Oct. 9, 2001, and U.S. Provisional Application No. 60/342,928 filed Oct. 19, 2001, both of which are hereby incorporated by reference.

BACKGROUND

1. Field of the Invention

The invention relates to modular furniture, and more particularly to foldable modular seats.

2. Background of the Invention

Permanent seating is used in many settings to provide a classic or elegant look. For example, pews in the sanctuaries of religious institutions are designed to provide a reverent look. Such seating is typically made of wood and aesthetically designed to help create the atmosphere desired for the particular use.

Many institutions that use such seating, particularly religious institutions, have a given number of seats or pews permanently mounted to the floor. When additional seating is needed for expected overflow, such as for holidays or special occasions, additional seating is provided with portable folding seats set up in areas adjacent to the permanent seats, such as in an adjacent room separated from the main room by a removable wall.

Unfortunately, typical portable seats do not match the permanent seats or provide the atmosphere desired. With pews in particular, which provide rows of connected seating, individual portable seats which generally hold a single person provide a second class look and feel. Moreover, portable seating lacks many of the functions and features of the permanent seats such as book shelves located on the back of pews that conveniently hold books and other materials for those in the row of seats immediately behind.

Accordingly, it is an object of the present invention to provide portable seating that can better match the aesthetic look of the permanent seats.

Another object is to provide portable seating that can is connectable to provide a row of seats.

A further object is to provide portable seating that can be quickly set up or removed, and which can be efficiently stored.

Additional objects, advantages and novel features of the invention will be set forth in part in the description which follows, and in part will become apparent to those skilled in the art upon examination of the following or may be learned by practice of the invention.

SUMMARY OF THE INVENTION

The present invention, in one aspect, provides a portable seating system that includes at least two seat modules. Each of the seat modules is foldable between an upright position for seating and a folded position for storage, and each has a back support member, a seat member pivotally movable relative to the back support member for rotation between the upright position and the folded position about a generally longitudinal axis, the seat member being in a position for use as a seat when the module is in the upright position and folded downward towards the bottom of the seat module when in the folded position. Each seat module further has a pair of end supports spaced from one another, each of the pair of end supports being positioned to support the seat member when the module is in its upright position, and foldable to a position under the seat member to allow the seat member to move to the folded position when the module is in its folded position. The seat modules are connectable to one another when in the upright position to form a connected row of such seat modules.

In another aspect, the present invention provides a method for providing portable seating. The method includes the following:

A) setting up a row of seats by 1) providing at least two seat modules, wherein each of the seat modules has at least two seats, and each of the modules is foldable between an upright position for use, and a folded position wherein the seat modules are folded to a compact form, 2) connecting at least two of the seat modules in the upright position to form the row of seat modules; and B) removing the row of seats by 1) disconnecting the connected seat modules from one another, and 2) folding the seat modules to the compact form.

A portable seat module foldable between an upright position for seating and a folded position for storage is also provided.

Means for storing the folded seat modules is also provided. In particular, stationary racks and wheeled racks are provided. In another embodiment, a rack having a decorative panel to mask the seat modules stored on it is provided.

BRIEF DESCRIPTION OF THE DRAWINGS

These and other features, aspects, and advantages of the present invention will become better understood with reference to the following description, appended claims, and accompanying drawings where:

FIG. 7A is a cross sectional detailed view showing a bolt connection of a seat module to another seat module;

FIG. 7B is a cross sectional detailed view showing the snap connection between two seat modules;

FIG. 7C is a cross sectional detailed view showing a bolt connection of an end panel to a seat module;

FIG. 10 is a front perspective view of the seat module of FIG. 9 fully folded;

FIG. 11 is a perspective view of two seat modules nested together for storage;

FIG. 13A is the detail 13A shown in FIG. 13;

FIG. 15 is a schematic view looking down on a curvilinear row of seat modules.

DETAILED DESCRIPTION

Illustrated and described herein is a preferred embodiment of the invention suitable for use in a religious setting. It is understood, however, that the present invention is not so limited, and can be used in other settings as well.

Figure 1:
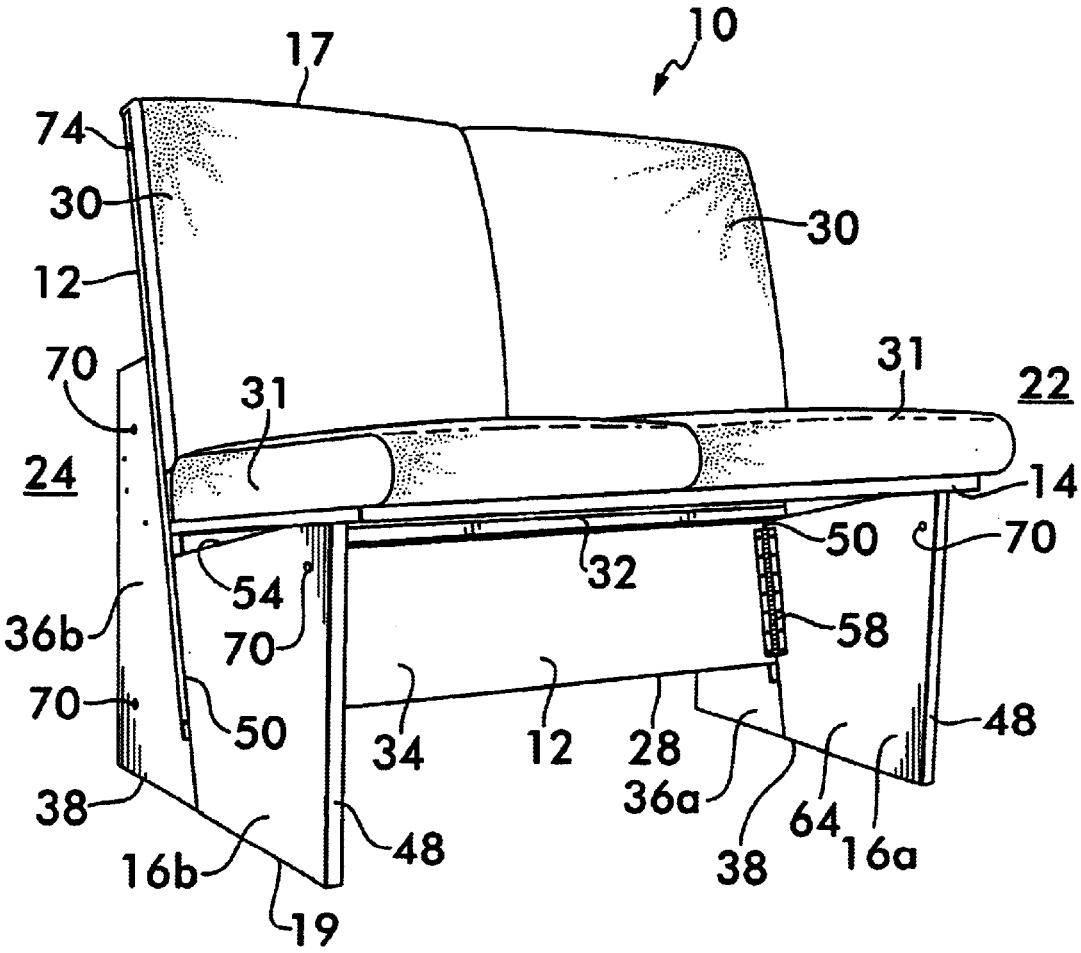
FIG. 1 is a front perspective view of a seat module in accordance with the present invention.

With reference to FIGS. 1, 2, 3 and 4, a pew for use in a religious sanctuary such as a church or synagogue is illustrated. A seat module 10 has a back support member 12 (FIG. 2), a seat member 14 sized to seat two people as shown, and a pair of end supports 16*a*, 16*b*. For purposes of orientation, the seat module 10 has a front side 18 (FIG. 2), a back side 20, and right and left sides 22, 24 respectively, as viewed from the front of the seat module 10 (FIG. 1). It also has a top side 17 and bottom side 19 that rests on the floor.

Figure 8:
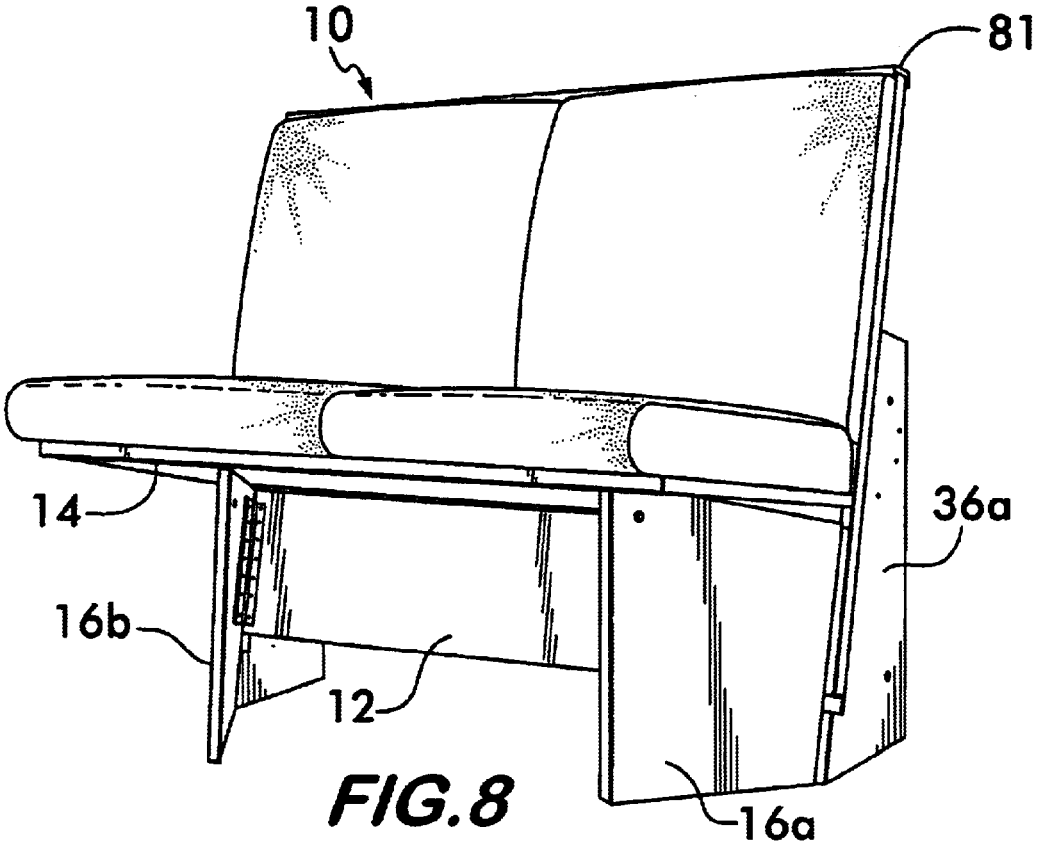
FIG. 8 is a front perspective view of an individual seat module of FIG. 7 being folded.
Figure 9:
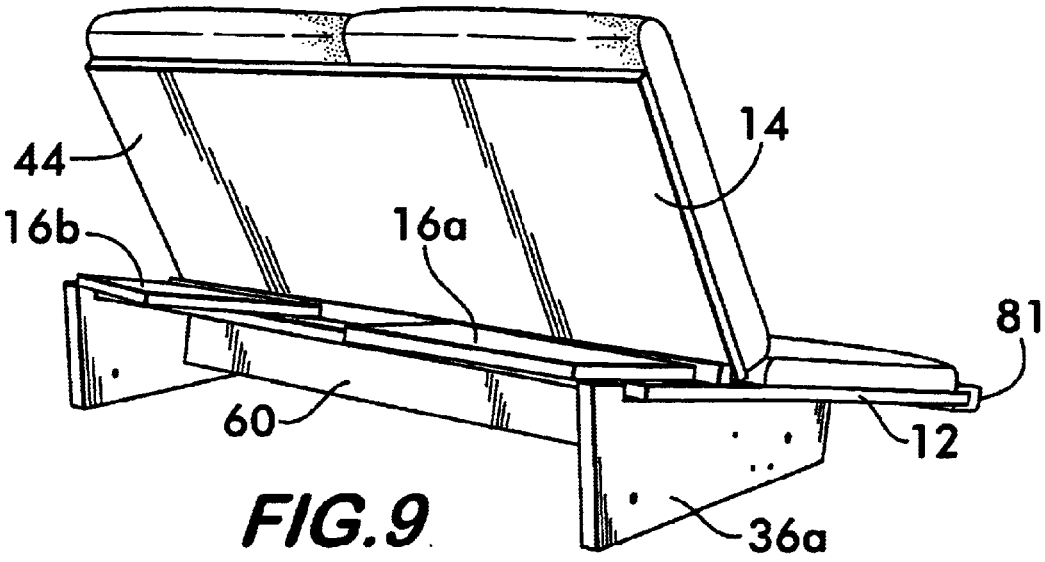
FIG. 9 is a front perspective view of the seat module of FIG. 8 during the folding process.
Figure 12:
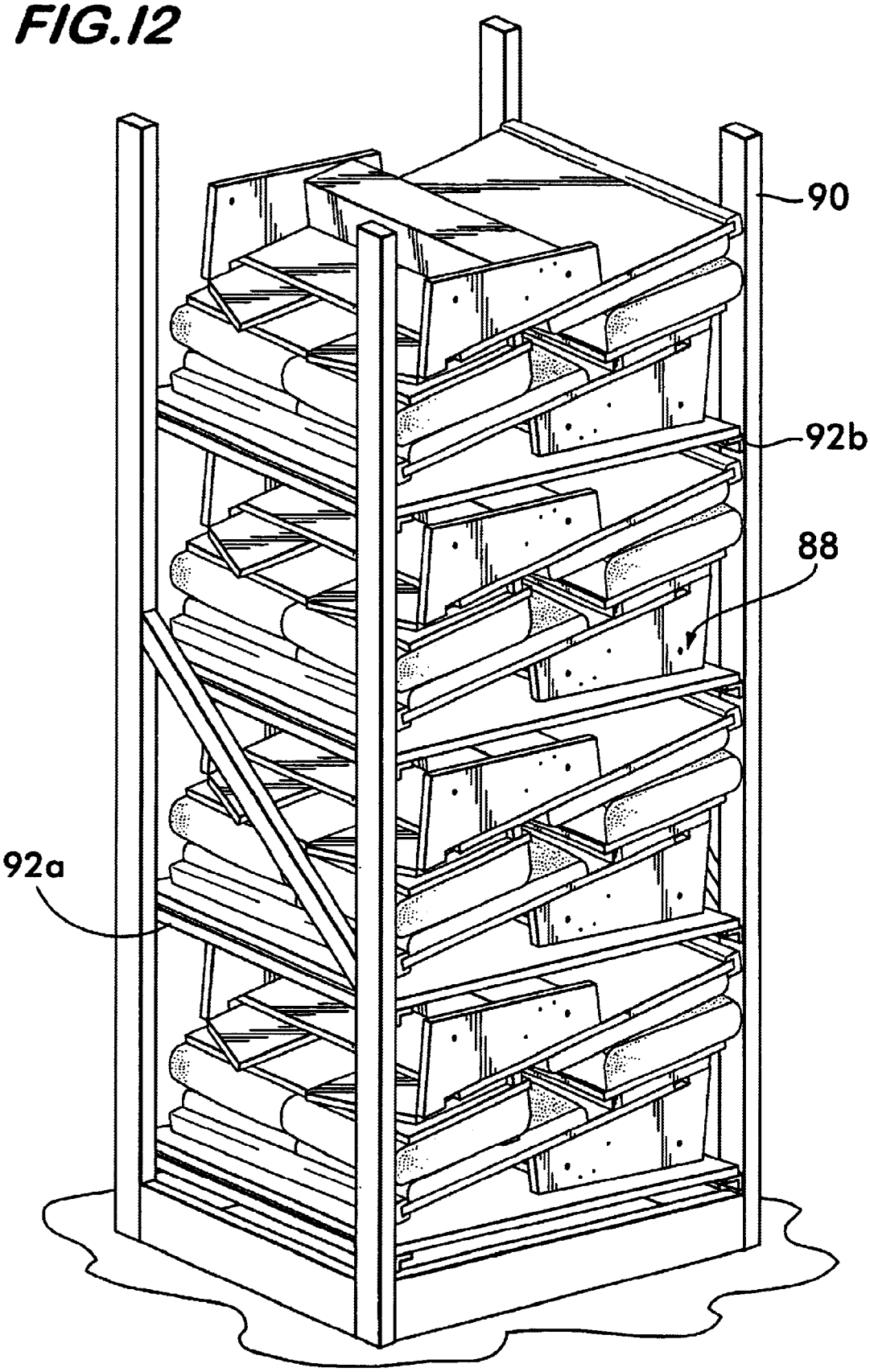
FIG. 12 is perspective view of a group of folded seat modules stored on a storage rack.

For this particular embodiment, the back support member 12 is formed as a singular flat wooden panel extending between the side ends 22, 24 as shown, and has a top edge 26 and a bottom edge 28. The bottom edge 28 extends below the seat member 14, but is raised above the ground a suitable distance as shown (FIGS. 1 and 4) to provide foot room for people seated behind the module 10. Back cushions 30 and seat cushions 31 provide added comfort and are secured to the respective back and seat members by any suitable means, e.g., velcro, bolts, etc. An alternative design for the top edge 26 of the back support 12 is shown in FIGS. 8 and 9, a wooden cap 81 that extends above the back cushion.

Figure 2:
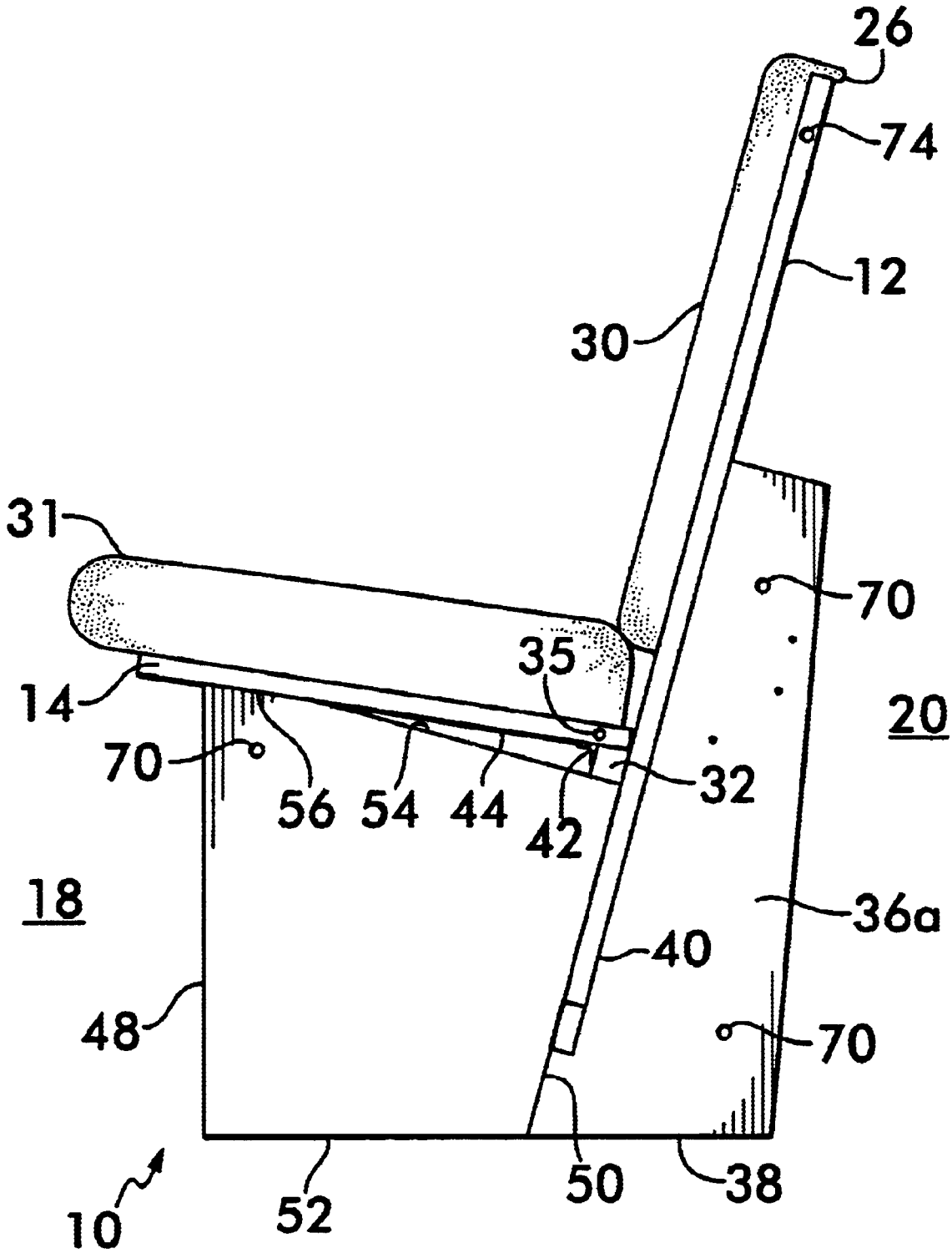
FIG. 2 is a side view of the seat module of FIG. 1.
Figure 3:
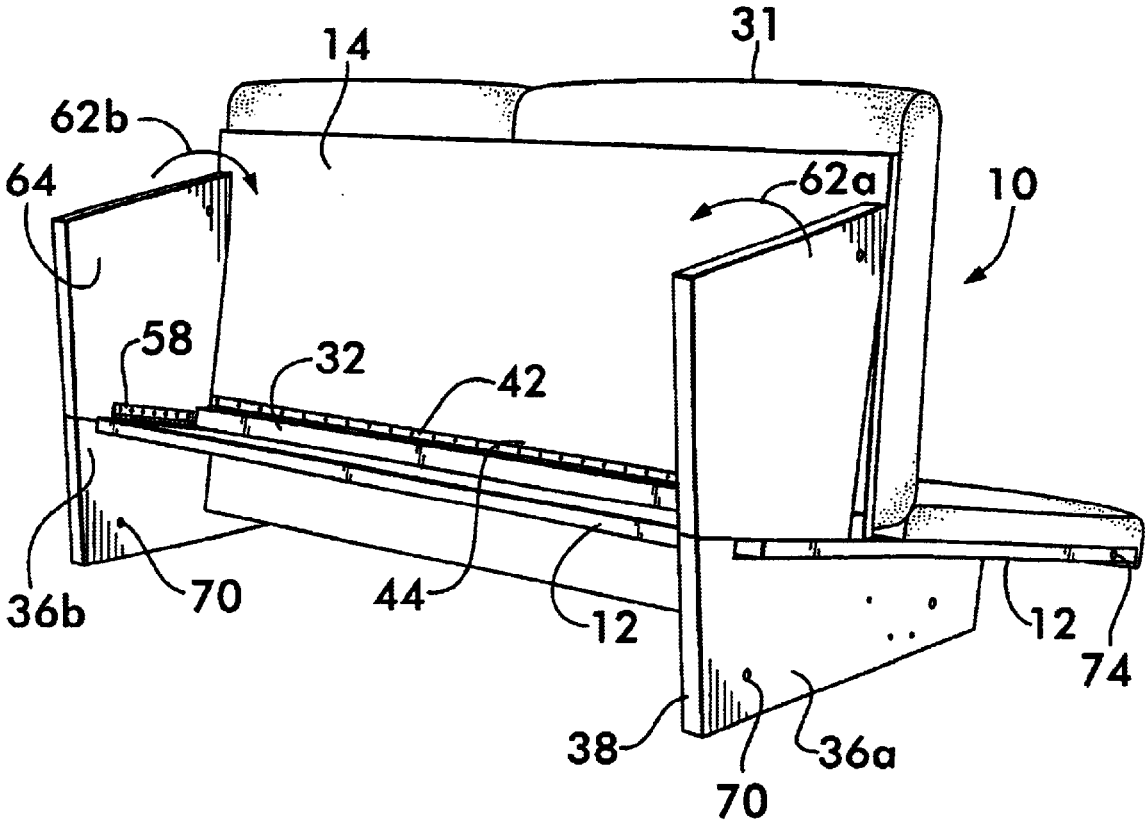
FIG. 3 is a bottom perspective view of the seat module of FIG. 1.

Attached to the back support member 12 is a support bar 32. Having a generally rectangular cross section, the support bar 32 extends longitudinally across the front side 34 of back support member 12 between right and left sides 22, 24 and is positioned to support the rear end 35 of the seat member 14 as can be seen in FIGS. 2 and 3.

Extending rearward from both sides 22, 24 of back support 12 are back extensions 36*a*, 36*b*. The bottom edge 38 of each extension 36*a*, 36*b* rests on the floor as shown and helps support the module 10 in the upright position, acting as legs to support the seat module 10 in cooperation with the end supports 16*a*, 16*b* which also act as legs. The extensions 36*a*, 36*b* have a cut out 40 (FIG. 2), the back support member 12 attaching to the extensions 36*a*, 36*b* in the cut out 40. Here, the extensions 36*a*, 36*b* are formed of a flat panel-like piece.

The seat member 14 is moveable relative to the back support 12 between an upright position for use and a folded position for storage (see FIGS. 1 and 10). In the illustrated embodiment, the seat member 14 is pivotally attached near its rear side 35 to the back support member 12 through the support bar 32. Any suitable attachment means may be used. Here the seat member 14 is attached to the back support member 12 via a piano hinge 42 having one leaf of the hinge screwed to the underside 44 of the seat member 14 and the other leaf to the support bar 32. It is seen that the piano hinge 42 allows the seat member 14 to be rotated or folded about a longitudinal axis 46 (FIG. 5) between the upright position shown in FIGS. 1 and 2 where the seat member 14 is in a generally horizontal seating position for use and a folded position shown in FIGS. 6 and 10 which is further described below. The illustrated seat member 14 is formed of a singular flat wooden panel.

The end supports 16*a*, 16*b* are spaced from one another on either side of the module 10, each having a front edge 48, rear edge 50, bottom edge 52, and top edge 54. The bottom edge 52 is parallel with the bottom edge 38 of the extensions 36*a*, 36*b*, resting on the floor and acting as legs to support the module 10. The top edge 54 of each support 16*a*, 16*b* includes a seat support section 56 (FIG. 2) for contacting and supporting the underside 44 of the seat member 14 in its upright seating position. Here, the top edge 54 supports the front section of the seat member 14 as shown, which, in cooperation with the support bar 32 and piano hinge 42 supporting the rear section, provides a sturdy support for the seat member 14. Here the end supports 16*a*, 16*b* are formed of singular flat panels of wood-like material.

Each end support 16*a*, 16*b* is movably attached to the remainder of the seat module 10 so as to be movable to a position that allows the seat member 14 to be folded to form a generally flat module 10 for storage as illustrated in FIG. 10. In the illustrated embodiment, the seat member 14 can be folded downward towards the floor or bottom side 19 (as oriented in FIG. 1) after the end supports 16*a*, 16*b* are folded out of the way. Here, each end support 16*a*, 16*b* is pivotally attached near its rear edge 50 to the back support member 12 at opposite sides of the back support 12 for pivotal movement about an axis generally perpendicular to the longitudinal axis 46. This is accomplished with a piano hinge 58 screwed to the respective members as shown, which provides the desired movability and which is of suitable length to provide a sturdy attachment to the back support member 12 for a sturdy and safe seat module 10 when in use. As one possible alternative to pivotal attachment near the rear edge 50, it is contemplated that the end supports 16*a*, 16*b* could be pivotally attached near the top edge 54 of each end support 16*a*, 16*b* to the underside 44 of the seat member 14 so that the bottom edge of each end support could fold upwards towards the center of the underside 44 of the seat member 14. This would likewise allow the end supports to be folded so as to permit the folding downward of the seat member 14.

Figure 4:
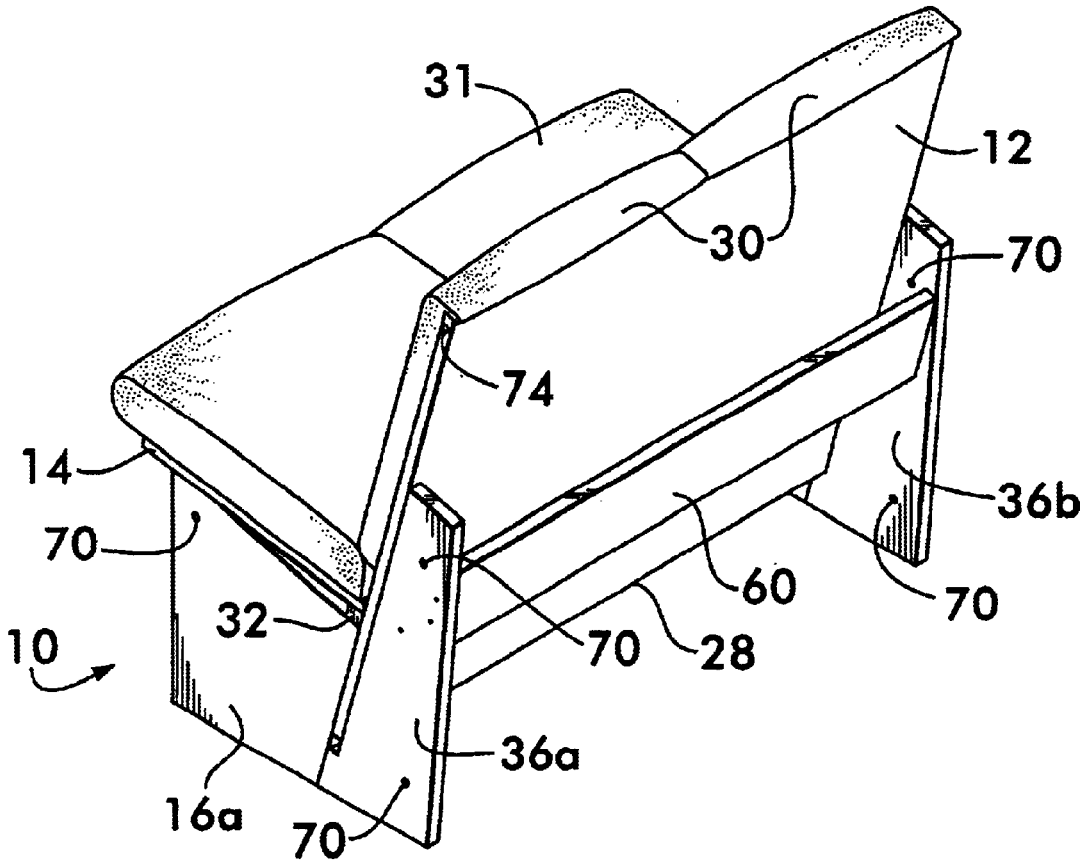
FIG. 4 is a side-rear perspective view of the seat module of FIG. 1.

With reference to FIG. 4, it is seen that a book rack 60 is readily provided along the back side of the module 10, here the rack 60 being attached in a known manner between and to the opposing sides of the extensions 36*a*, 36*b*.

Figure 5:
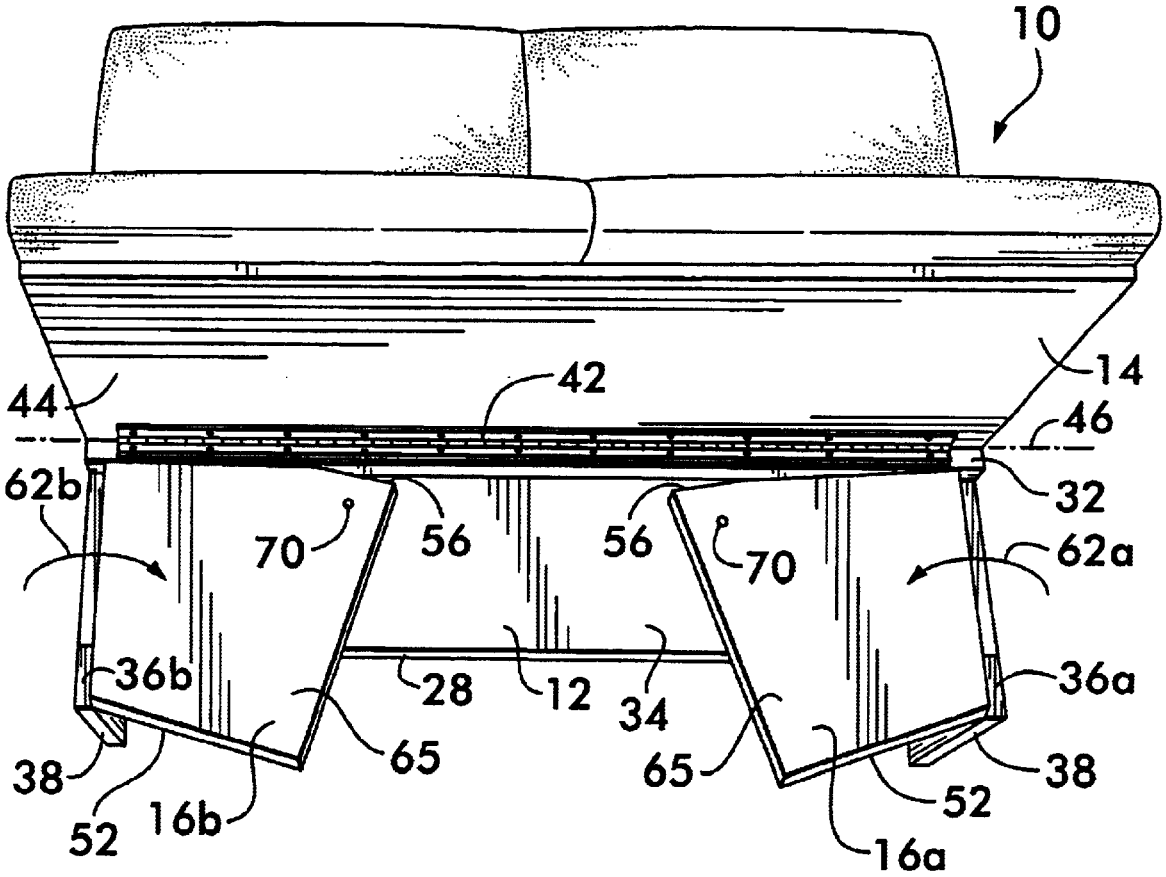
FIG. 5 is a front view of the module of FIG. 1 shown with the end supports folded.
Figure 6:
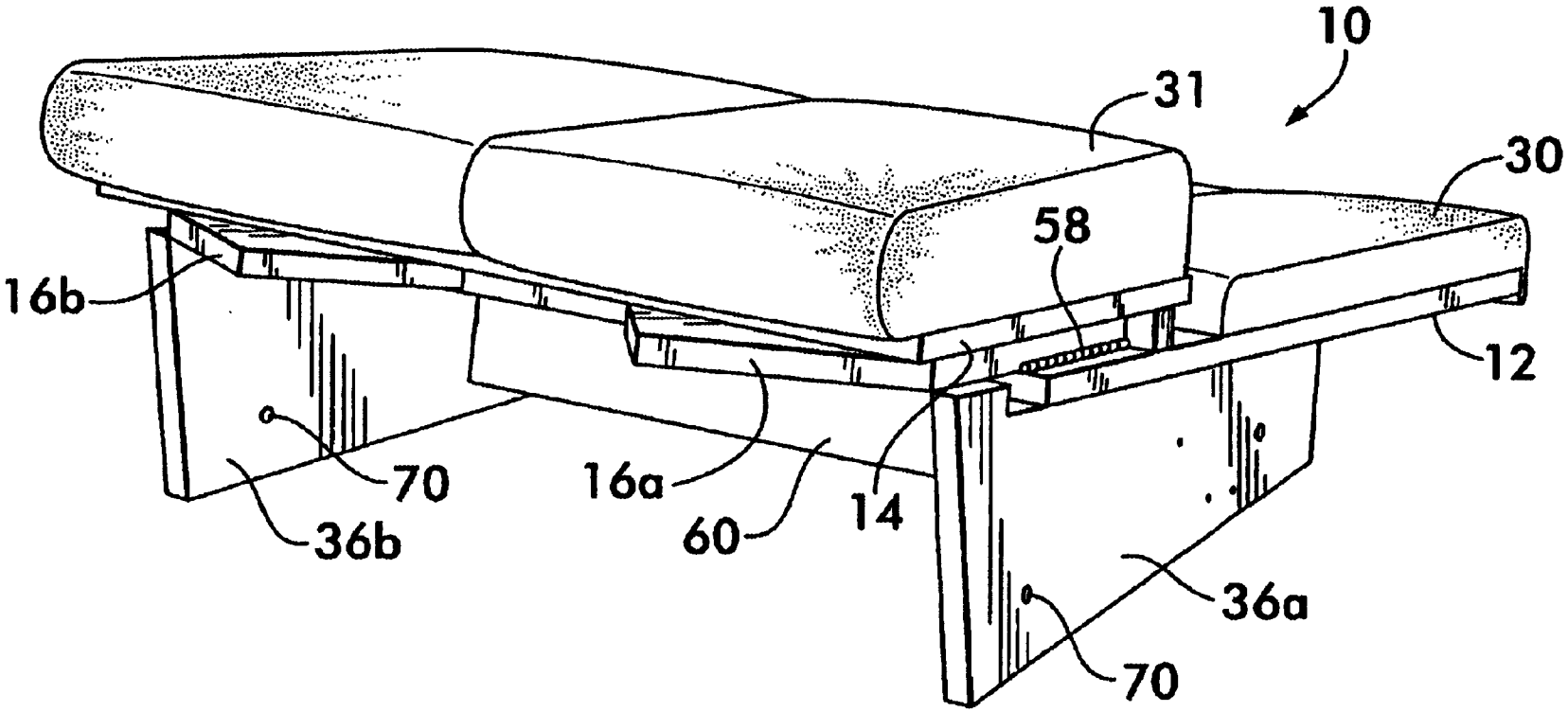
FIG. 6 is a side perspective view of the seat module of FIG. 1 shown in the folded position.

Having been described in its upright form as used for seating, the seat module 10 will now be described in its folded position which allows for convenient storage in a compact form. Moreover, the folding process allows convenient and quick assembly and disassembly of the seat modules for use or storage. With reference to FIG. 5 (the module 10 shown leaning backwards), the seat member 14 has been manually lifted upwards a sufficient distance to allow the folding of each of the end supports 16*a*, 16*b* about the piano hinges 58 in the directions 62*a*, 62*b* toward the center of the module 10 (the directions 62*a*, 62*b* also shown in FIG. 3), with the inside faces 64 of the end supports 16*a*, 16*b* coming to rest on the front side 34 of a lower section of the back support member 12 beneath where the seat member 14 attaches to the back support member 12 (via support bar 32). Next, the seat member 14 is folded downward about the longitudinal axis 46 defined by the piano hinge 42 to be on top of the outer faces 65 of the end supports 16*a*, 16*b*, thereby becoming generally parallel with the back support member 12 as shown in FIGS. 6 and 10 to complete the folding process. It is seen that the end supports 16*a*, 16*b* are sandwiched between the seat member 14 and the lower section of the back support member 12.

One advantage of the present invention is that multiple seat modules 10 can be interconnected to form a row of modules. Multiple rows of such modules can be created to provide as much seating as desired. This is ideal for portable or temporary seating in churches and synagogues where additional temporary seating beyond the permanent pews is needed, and where it is desired to add seating that maintains the reverent look of the existing pews. It is appreciated that the modules 10 of the present invention can be made from any suitable material, wood being typical of religious settings, and can be designed for a particular look or to match the design of existing pews.

Figure 7:
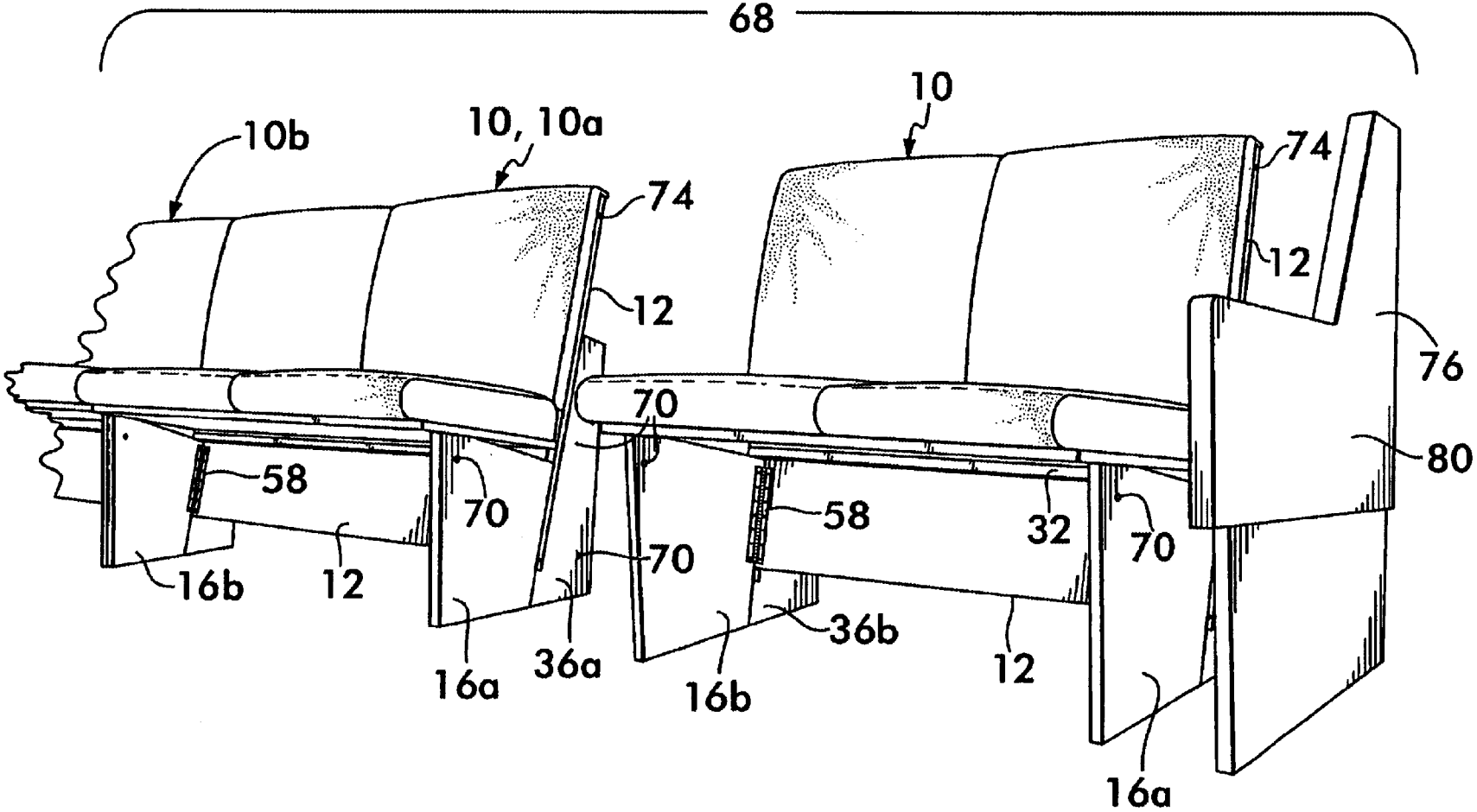
FIG. 7 is perspective view of seat modules being connected to form a row of seats.

As illustrated in FIG. 7, connection of several modules 10 to one another is possible to create a row 68 of as many seats as desired. The up righted modules 10, 10*a*, 10*b* are placed adjacent one another as shown. Two bolt openings 70 (FIG. 4) in each of the back extensions 36*a*, 36*b* and one bolt opening 70 in each of the end supports 16*a*, 16*b* allow one module 10 to be connected to an adjacent module 10*a*, e.g., extension 36*a* and end support 16*a* of one module 10*a* is bolted to the adjacent extension 36*b* and end support 16*b* of another module 10. As shown in FIG. 7A showing a detail of the end support 16*b* of one module 10 connected to the end support 16*a* of the module 10*a*, male and female bolt sections 72 with heads for easy handling are preferred, although any suitable fastener may be used. To further aid in the alignment and connection of the individual modules 10 and 10*a*, registration pins or cooperating snap assemblies 74 (see FIG. 2 and FIG. 7B) can be provided in the side end of the back supports 12. This helps keep the back supports 12 aligned with one another.

If desirable, the rows can be anchored to the floor for added stability.

Where a more finished or complete look is desired, end panels 76 can be provided for the two opposite ends of the row 68 (see FIG. 7). The end panel 76 of a desired design can be connected to the ends of the row 68, i.e., the unconnected ends of the seat modules at the end of the row 68, using the same bolt holes 70 and snap-ins 74 used to connect two seat modules 10 to each other. For example, with reference to FIG. 7C, the three holes 70 on the end of the module 10 align with three recesses 78 in the end panel 76. A female fastener piece 70*a* is screwed into the recess of the end panel 76 for receiving the male end of a bolt 70*b*, providing an attachment means invisible on the outer face 80 of the end panel 76. A pin or snap can also be provided in the end panel 76 to connect with the corresponding piece 74 on the seat module 10. Such end panels 76 can take on different aesthetic designs for different uses. In the illustrated embodiment, the end panel 76 provides a similar look as an end piece of a permanent pew, and provides a panel section higher then the seat member 14 to act as an end or stop to prevent users from sliding off the end of the seat module 10, and can also provide an arm rest.

It is seen that the embodiment illustrated in the FIGS. provides at least four point support above the floor. For example, with reference to FIGS. 1 and 2, it is seen that the bottom side 19 of the seat modules 10 contacts the floor in multiple places along the bottom edge 38 of the extensions 36*a*, 36*b* and the bottom edge 52 of the end supports 16*a*, 16*b*. This provides a stable support of the module 10.

Rows of various shapes are also possible. For example, with reference to FIG. 15, an intermediate member or spacer 82 can be connected between adjacent modules 10, using the fastening means as described above, to form the desired shape of the row 68. By controlling the shape of the spacer 82, a curve can be added to the row 68 as shown. Thus various shaped rows are possible, including straight, angled and curvilinear. For example, the width of the rear panel 84 of the spacer 82 as compared to the width of the front panel 86 can be selected for the desired degree of curvature. Likewise, the height of the spacer 82 could be higher than the seat member 14 to act as an end of each module 10 or as a stop to prevent the user from sliding off the seat member 14. Such spacers are disclosed in my U.S. Patent Application 60/342,928 filed Oct. 19, 2001 and which is hereby incorporated by reference. It is understood that the spacers need not be shaped to provide a curvature to the row, but can be simple spacers. For example, a non wedge shaped intermediate member 84 similar to the end panel 76 may be used to provide a spacing between modules or even to act as an intermediate, divider, or end panel for the individual seat modules 10.

An advantage of the present invention is the ease with which the seat modules 10 can be up righted for use, and then disconnected, folded and stored for later use. This sequence from the setting up of the seating modules to the folding and storage of the modules is now described with reference to FIGS. 7 through 12.

The up righting and connection of multiple modules 10 to create rows 68 of seats is completed as described above with reference to FIG. 7. Once the need for the seats has passed, the seats are then folded and stored for future use. To disassemble the row, the fasteners connecting the various modules 10 and end panels 76 are disconnected, e.g., unbolting the bolts 72 and breaking the snap connections 74 between the modules 10 and end panels 76.

The individual modules 10 are then folded to a generally flat configuration where the seat member 14 is generally parallel to the back support 12. As shown in FIGS. 5 and 8, the seat member 14 is lifted up slightly to allow the end supports 16*a*, 16*b* to be folded inward toward the center of the module 10, coming to rest on the lower portion of the back support 12. With further reference to FIG. 9, the seat member 14 is then lowered, pivoting about the longitudinal axis 46 of piano hinge 42, the underside of the seat member 14 coming to rest on the outer face of the folded end supports 16*a*, 16*b* as seen in FIGS. 6 and 10. This forms the generally flat configuration as shown in FIGS. 6 and 10.

A second folded module 10*a* can be placed on top of the module 10 to form a nested arrangement 87 as shown in FIG. 11 for efficient storage. The folded modules 10 can be stored individually or in the nested arrangement 87 on trays 88 as now described with reference to FIG. 12.

Efficient storage of the modules 10 is provided with racks 90 having shelves 92 onto which the trays 88 can be slid. The shelves 92 can be formed of two members 92*a*, 92*b* on opposite sides of the rack 90 and made of any suitable structural material capable of supporting the trays 88, e.g., two lengths of angled steel having a flat surface on which the trays slide, etc. A low friction surface is preferably provided on the shelves 92, such as rollers or low friction tape to allow easy sliding of the trays 88 on the shelves 92. The preferred embodiment has four shelves for holding eight modules 10 in nested configurations. The racks 90 can be located in any place where it is desired to store the modules 10.

Figure 13:
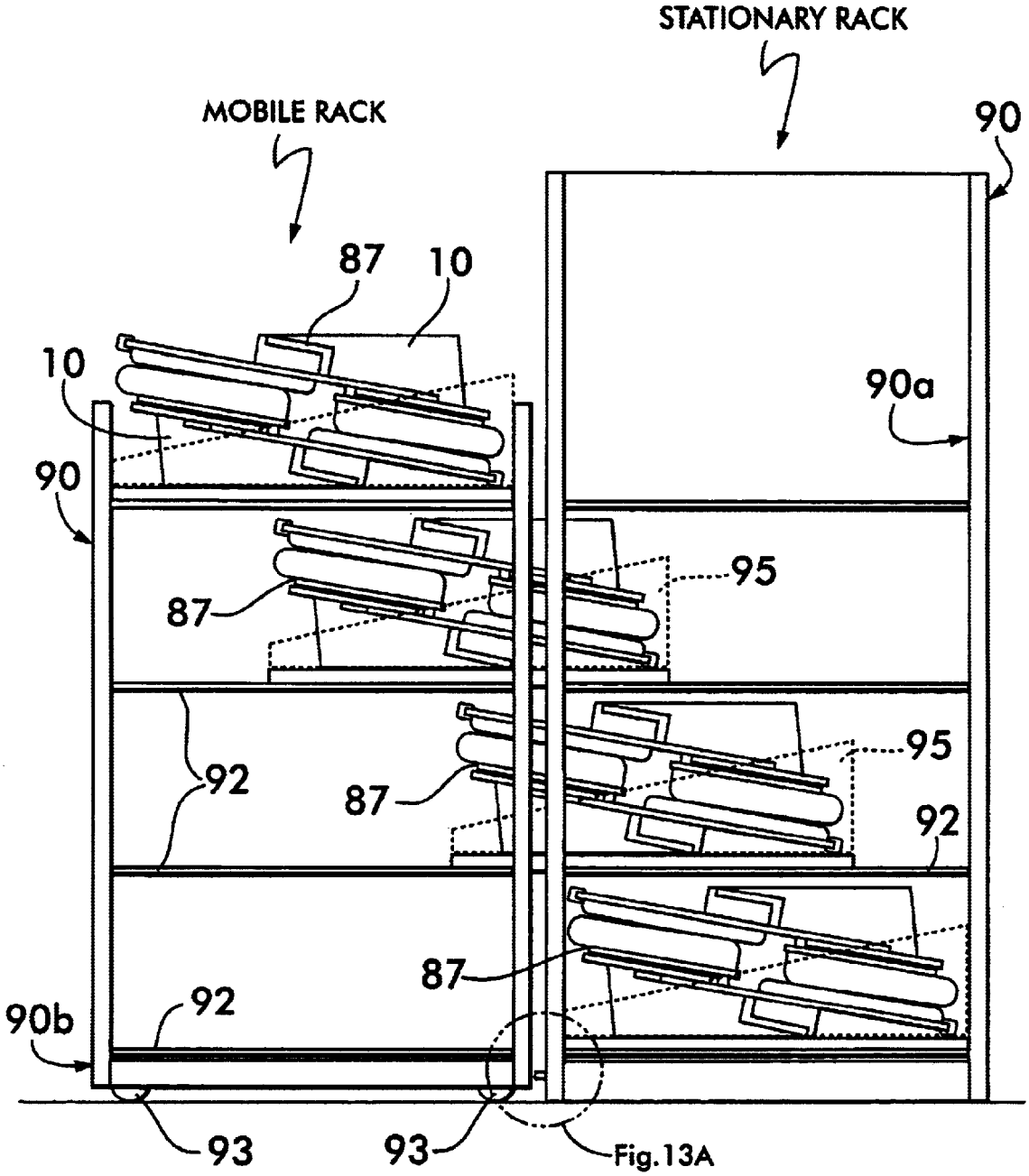
FIG. 13 is a perspective view of a portable storage rack adjacent a stationary storage rack with seat modules on trays being transferred from one rack to the other.

With reference to FIG. 13, it is appreciated that the racks 90 can be provided with wheels 93 to be easily movable (portable). This allows multiple modules to be moved together to the area where they will be set up or stored after being folded, thereby minimizing the labor involved with set up and disassembly. It is further appreciated that a combination of non wheeled racks (permanent storage racks 90*a*) and portable racks 90*b* can be used. For example, a suitable number of permanent storage racks 90*a* can be provided in the area desired for storage. One or two portable racks 90*b* with wheels 93 can be provided to move the seat modules 10 from the area where they were used to the storage area. As shown in FIGS. 13 and 13A, the portable rack 90*b* is moved next to the stationary rack 90*a* where the trays 88 can be slid from the shelves 92 of the portable rack to the shelves 92 of the stationary rack. With further reference to FIG. 13A, a registration system 96 whereby a pin 97 on one rack is inserted into an opening 98 of the other rack insures proper alignment of the shelves for easy transfer. To remove the modules 10 from storage to the site intended for use, the above process is reversed. FIG. 13 also shows that the trays can have protective side panels 95 (shown in dotted line) to protect the modules 10 during storage.

Figure 14:
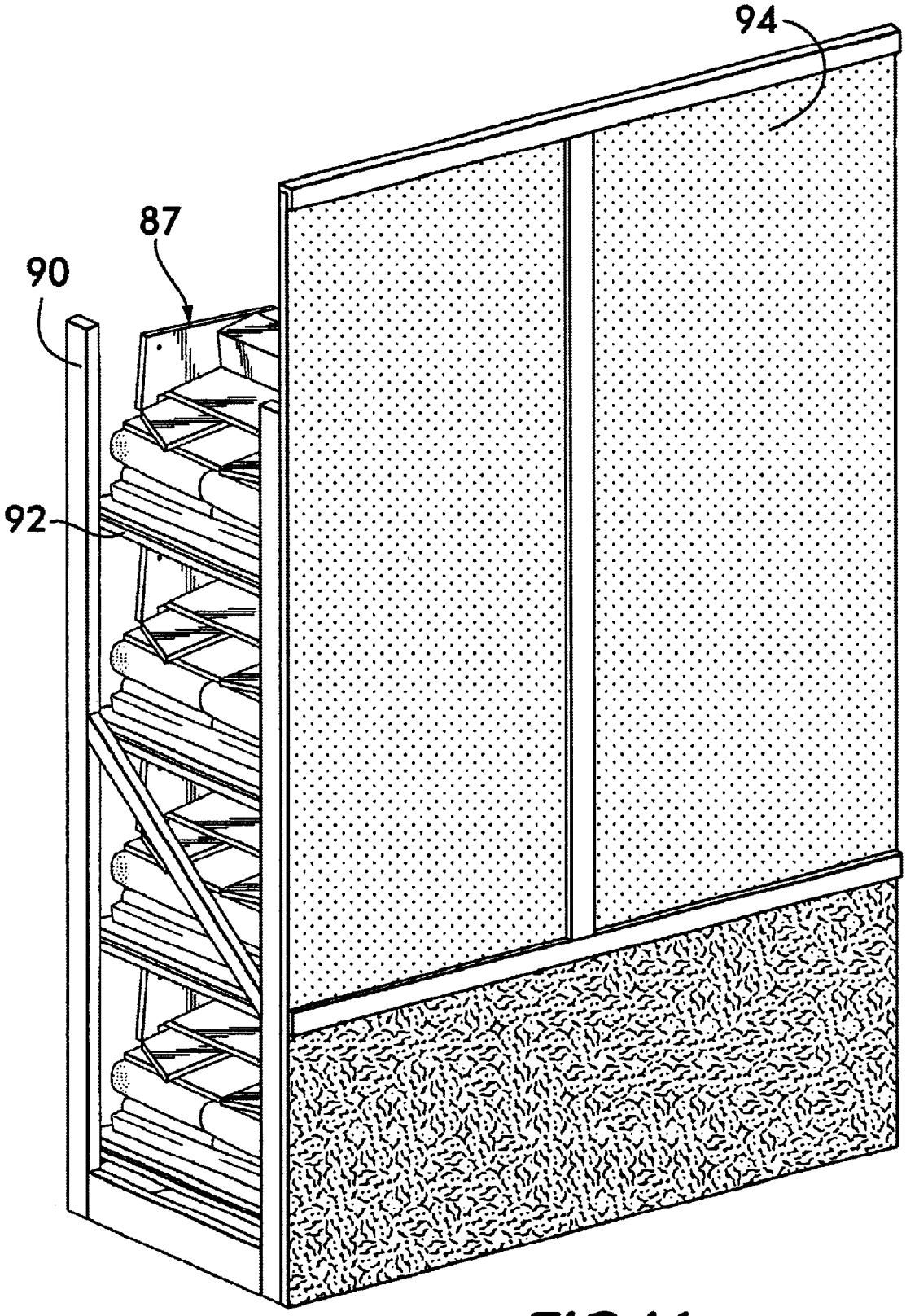
FIG. 14 is perspective view of a storage rack having a decorative panel.

The present invention further provides a storage means that masks the rack 90 and seat modules 10 therein from view. With reference to FIG. 14, a rack 90, wheeled or stationary, has a decorative panel 94 mounted on the back face of the rack 90 opposite from the side on which the modules 10 are slid onto the shelves 92. The panel can be designed to match the design of the room in which the racks will be placed. Multiple such racks 90 with decorative panels 94 can be placed adjacent one another to form a wall like configuration behind which the modules 10 are stored. If wheeled to be portable, such racks are readily moved to where needed and then configured again to form the wall like structure masking the modules as desired.

It is appreciated that the present invention provides a novel seating module and a system of using such modules having numerous advantages. It can provide portable and temporary seating that can match or be similar to the permanent seating already in place. The modules are easily stacked and stored until needed, and then can be quickly and easily set up. While a two-seated module has been illustrated herein, it is appreciated that other size modules are possible—one seat modules, three seat modules, etc.

The system is also flexible. Various configurations are possible, from rows of multiple seat modules to rows of desired shapes. Because of the interchangeability of the system, quick repairs and or replacement of broken pieces is possible.

Other advantages, benefits and features are readily contemplated by those of ordinary skill in the art. While the illustrated embodiment is directed at pews, it is readily understood that the present invention is not so limited, and is applicable to other seating modules.

What is claimed is:

1. A portable seating system, comprising:

at least two seat modules, each of said seat modules being foldable between an upright position for seating and a folded position for storage, each of said seat modules having:

a back support member;

a seat member pivotally movable relative to said back support member for movement between said upright position and said folded position about a generally longitudinal axis, said seat member being in a position for use as a seat when said module is in said upright position and folded downward towards the bottom of the seat module when in said folded position;

a pair of end supports spaced from one another, each of said pair of end supports being positioned to support said seat member when said module is in its upright position, and foldable to a position under said seat member to allow said seat member to move to said folded position when said module is in its folded position; and said seat modules being connectable to one another when in the upright position to form a row of said seat modules.

2. A portable seating system in accordance with claim 1 wherein said modules are connectable directly to one another at adjacent ends.

3. A portable seating system in accordance with claim 2 wherein said back support member comprises a single flat panel having first and second ends, and further comprises first and second back extensions extending rearward and having a bottom edge for cooperating with a bottom edge of said end supports to support said module above the floor when said module is in said upright position.

4. A portable seating system in accordance with claim 1 wherein said modules are connectable to one another via an intermediate member connectable directly to opposing ends of said two modules.

5. A portable seating system in accordance with claim 4 wherein said intermediate member is configured to form a curved row of connected seat modules.

6. A portable seating system in accordance with claim 4 wherein said intermediate member comprises a wedge shaped spacer so as to form a curved row of seat modules, said spacer having a front side and a back side, said back side having a width grater than a width of said front side.

7. A portable seating system in accordance with claim 1 further comprising a removable end panel connectable to a side end of one of said modules to form an end of said row.

8. A portable seating system in accordance with claim 1 wherein said seat member is attached pivotally to said back support member to be pivotal about a longitudinal axis extending from side to side of said module.

9. A portable seating system in accordance with claim 8 wherein said end supports are attached pivotally to said back support member such that a front end of said support can be folded toward said back support member.

10. A portable seating system in accordance with claim 8 wherein said seat member is attached pivotally to said back support member via a piano type hinge.

11. A portable seating system in accordance with claim 1 further comprising a storage rack for holding said seating modules when said seating modules are in the folded position, said rack having at least two shelves spaced vertically from one another.

12. A portable seating system in accordance with claim 1 wherein each of said seat modules comprise at least two seats.

13. A portable seating system in accordance with claim 1 wherein at least one of said seat modules has a book rack attached to a back side of said one seat module.

14. The portable seating system of claim 1 wherein each of said seat modules has at least four point support against the floor.

15. A portable seating system, comprising multiple seat modules, each of said modules being foldable between an upright position for use, and a folded position wherein said seat modules are folded to a compact form for storage, said seat modules being connectable to one another when in the upright position to form a connected row of said seat modules having an end;

each of said seat modules having a back support member and a seat member pivotally moveable relative to said back support member, and a pair of end supports spaced from one another, each of said pair of end supports being positioned to support said seat member when said module is in its upright position, and foldable to a position under said seat member to allow said seat member to move to said folded position when said module is in its folded position; and a removable end panel connectable to a side end of one of said seat modules at said end of said row, said end panel being disconnectable from said modules for storage.

16. A portable seating system in accordance with claim 15 wherein at least one of said seat modules is sized to comprise at least two seats.

17. A portable seating system in accordance with claim 15 further comprising a storage rack for holding said seating modules when said seating modules are in the folded position, said rack having at least two shelves spaced vertically from one another.

18. A portable seating system in accordance with claim 17 wherein said storage rack further comprises a decorative panel on a side of said rack masking any of said modules stored therein from a view from a side of said decorative panel opposite said shelves.

19. A portable seating system in accordance with claim 17 wherein said storage rack includes wheels to permit movement of said rack.

20. A portable seating system in accordance with claim 17 wherein said seat modules are stored in pairs of modules nested on top of one another.

21. A method of providing portable seating, said method comprising:

A) setting up a row of seats by carrying out the following steps:

1) providing at least two seat modules, each of said seat modules having at least two seats, each of said modules being foldable between an upright position for use, and a folded position wherein said seat modules are folded to a compact form;

2) connecting at least two of said seat modules in the upright position to form said row of said seat modules; and B) removing said row of seats by carrying out the following steps:

1) disconnecting said connected seat modules from one another;

2) folding said seat modules to said compact form by folding a pair of end supports and a seat member, said end supports being spaced from one another and positioned to support said seat member when said seat module is in said upright position, said pair of end supports being folded to a position under said seat member to allow said seat member to move to a folded position relative to a back support member when said module is folded.

22. A method of providing portable seating in accordance with claim 21 wherein step A further comprises the step of connecting a removable end panel to a side end of one of said modules to form an end of said row, and step B further comprises the step of disconnecting said removable end panel.

23. A method of providing portable seating in accordance with wherein step B further comprises the steps of:

stacking at least two of said modules on top of each other;

placing said stacked modules on a shelf of a storage rack.

24. A method of providing portable seating in accordance with claim 21 wherein step A(2) comprises the step of connecting said at least two of said seat modules in the upright position to form said row of said seat modules via an intermediate member connected between said two seat modules.

25. A portable seat module foldable between an upright position for seating and a folded position for storage, said seat module comprising:

a back support member, said back support having first and second back extensions spaced from one another and having a bottom edge for contacting the floor and supporting said module above the floor when said module is in said upright position;

a seat member pivotally connected to said back support member for pivotal movement between said upright position and said folded position about a generally longitudinal axis, said seat member being in a generally perpendicular position relative to said back support member when said module is in said upright position and folded downward towards the bottom of the seat module generally parallel to said back support member when in said folded position;

a pair of end supports spaced from one another, each of said pair of end supports being positioned to contact the underside of said seat member to support said seat member when said module is in its upright position and having a lower end for contacting the floor and supporting said module above the floor when said module is in said upright position, each of said end supports being pivotally connected to said back support member along a line generally perpendicular to said longitudinal axis to a position under said seat member to allow said seat member to move to said folded position wherein a bottom face of said seat member faces a side face of said end supports when said module is in its folded position; and said seat module being connectable to another of said seat modules when in the upright position to form a connected row of said seat modules.

26. A portable seat module in accordance with claim 25 further comprising a removable end panel connectable to a side end of said module to form an end of said seat module, said end panel extending above said seat member to provide a stop for users sitting in said module.

* * * * *

UNITED STATES PATENT AND TRADEMARK OFFICE

CERTIFICATE OF CORRECTION

PATENT NO. : 6,874,850 B2
DATED : April 5, 2005
INVENTOR(S) : Michael Berkowicz

It is certified that error appears in the above-identified patent and that said Letters Patent is hereby corrected as shown below:

Column 10,
Line 8, after "with", insert -- claim 21 --.

Signed and Sealed this

Twenty-eighth Day of June, 2005

JON W. DUDAS
*Director of the United States Patent and Trademark Office*